US005348149A

United States Patent [19]

McCarthy

[11] Patent Number: 5,348,149

[45] Date of Patent: Sep. 20, 1994

[54] RACK APPARATUS FOR FOLDING CHAIRS

[76] Inventor: Timothy P. McCarthy, 348 Muirwood Dr., London, Ohio 43140

[21] Appl. No.: 900,166

[22] Filed: Jun. 17, 1992

[51] Int. Cl.[5] ..... B65D 90/16

[52] U.S. Cl. ..... 206/326; 108/53.1; 108/55.1; 206/386; 211/49.1; 211/194

[58] Field of Search ..... 108/53.1, 53.5, 55.1; 206/326, 386, 600; 211/49.1, 194; 220/1.5, 6, 7

[56] References Cited

U.S. PATENT DOCUMENTS

| | | | |
|---|---|---|---|
| 2,962,250 | 11/1960 | Carey et al. | 206/386 |
| 3,157,424 | 11/1964 | Hall | 211/194 |
| 3,565,018 | 2/1971 | Jay | 108/53.5 |
| 3,568,608 | 3/1971 | Taylor et al. | 108/55.1 |
| 3,665,869 | 5/1972 | Howe | 108/55.1 |
| 3,709,163 | 1/1973 | Smedley et al. | 108/55.1 |
| 3,994,241 | 11/1976 | Evans | 108/53.5 |
| 5,016,765 | 5/1991 | Leonardo | 21/194 |

FOREIGN PATENT DOCUMENTS

| | | | |
|---|---|---|---|
| 2346140 | 3/1975 | Fed. Rep. of Germany | 108/55.1 |
| 2510253 | 9/1976 | Fed. Rep. of Germany | 206/386 |
| 0111252 | 5/1991 | Japan | 108/55.1 |
| 0927361 | 5/1963 | United Kingdom | 108/53.5 |
| 1105664 | 3/1968 | United Kingdom | 108/55.1 |
| 1567942 | 5/1980 | United Kingdom | 206/600 |

*Primary Examiner*—Jimmy G. Foster
*Attorney, Agent, or Firm*—Mueller and Smith

[57] ABSTRACT

Rack apparatus for removably retaining and transporting a multitude of folded stack and stackable chairs is described. The apparatus includes a base frame upon which are mounted upstanding stanchions with alignment surfaces providing for the lined stacking of chairs in a sequence of chair stacking bays. The chairs may be locked within fully filled bays and the entire apparatus is movable with a conventional forklift truck into rack upon rack stacking orientations on the bed of a flat bed trailer for transportation to a site or for purposes on site and warehousing storage.

22 Claims, 4 Drawing Sheets

RACK APPARATUS FOR FOLDING CHAIRS

BACKGROUND OF THE INVENTION

The promotion, planning, and execution required of organizers and sponsors for producing larger public gatherings such as concerts, state fairs, and the like typically involve the employment of numerous support services. An important one of those services provides for the seating of patrons. Typically, principal or supplementary seating, for example on a stadium field, often will require chairs numbering in the tens of thousands. That use of the chairs will be for a very limited interval of time, for example, musical presentations often being held for a single day.

To provide this seating, chairs of essentially universal, metal folding design are used. Having general dimensions of 17½ in.×39¼ in. (44.5 cm×99.7 cm) and each weighing about 6½ lbs the chairs, when folded, exhibit a repeating geometry, for example in the positioning of front legs in adjacency with back legs and the like. As a component of their design, the chain, when so folded, stack, exhibiting individual stack weights in internested relationship to enhance their transportability in larger numbers. Commercial entities engaged in the rental-supply of these chain traditionally have stacked them from floor to ceiling in tractor-trailer rigs having conventional box bed trailers. Regulatory limitations, of course, are imposed upon the size (height and width) and gross weight of these rigs, for example, a limitation in the latter regard typically being about 80,000 pounds.

Procedures carried out in supplying the chairs to a user site are quite labor intensive and, at times, hazardous. Generally, a tractor-trailer rig carrying the stacked chairs is driven to an unloading location adjacent the site. Labor then is required to unload the chairs onto pallets or the equivalent positioned reasonably adjacent the trailer. Should the tractor-trailer rig have encountered a steep grade just before or upon reaching the site, the stacked chair load may have shifted to lean against the rear doors. This hazardous condition must be corrected by reshifting the load, for example, by driving the tractor trailer rig to a downward grade.

Upon unloading and stacking chairs upon pallets or, very often, conventional sheets of plywood mounted upon some form of low standoff, they are moved by forklift trucks to the edge of the user site, for example, next to a stadium field. This movement also can be hazardous should the forklift trucks encounter unlevel or hilly terrain. In the latter regard, should the load tip, it may be lost or, at best, the number of chairs to be carried per trip with the forklift truck becomes limited. The chairs then are positioned at their intended location by the labor crews.

Many concerts or similar public affairs extend to late hours. Thus, the chair moving crew again is called upon to essentially reverse the above procedure. In this regard, the chairs are folded and stacked at the side of the field upon pallets or the ubiquitous sheets of plywood. Forklifts then are called upon to move the chairs to a location adjacent the trucks. The chairs then are unloaded from the pallets and are hand stacked in the trailers. However, a next procedure is required at this point, the chairs must be counted as each stacking course is completed across the widthwise extent of the trailer. All of these activities occur late at night under highly undesirable labor conditions. Leaving the chairs upon the pallets until morning generally is found to be unacceptable, inasmuch as the chairs are subject to theft.

SUMMARY

The present invention is addressed to a rack apparatus employed in the storing and transporting of a multitude of folding chairs. The apparatus is structured having a rigid frame with a base and upstanding members mutually configured and arranged to define a plurality of chair aligning and retaining bays. Each of these bays is generally accessible for chair insertion and removal from the sides and top of the apparatus. The dimensions of the frame are selected with respect to both the width, the height, and stack height of folding chairs and further with respect to the width of the trailer component of a tractor-trailer rig. Generally, that trailer component will be of a flat-bed variety.

With the rack arrangement, a substantial savings is realized in the labor requirements otherwise required for unloading and set-up as well as for removal and reloading of chairs at a site. In this regard, the chair loaded racks are removed directly from flat-bed truck trailers by forklift trucks and transported directly to the set-up site. Thus, there is eliminated the substantial labor heretofore expended in hand unloading the chairs from a trailer onto pallets for forklift pick-up and transport. Of course, the hazards associated with hand unloading at the trailer also are avoided. Because the stacked chairs are contained in alignment by the rack structures, the hazards otherwise encountered in moving the chairs over hilly terrain using forklift trucks are avoided.

Through the use of simple containment components, the chairs may be loaded upon the racks adjacent the performing site and left overnight without undue fear of theft. Thus, the labor effort required in reloading the tractor-trailer may be carded out a next day with refreshed labor crews. The recovery of the chairs from the site also is achieved with substantial labor savings. Once the chairs are stacked within the bays of the rack frames, forklift trucks again move the frames to the trailers and position them thereon. Counting of the chairs is greatly simplified, a verification that all chairs are stacked in the same direction only being required, inasmuch as a predetermined number of chairs will be located within a fully loaded chair retaining bay. Labor requirements further are substantially reduced in that the hand reloading and stacking of the chairs within a box wailer is eliminated.

Another feature of the invention provides a system for retaining and transporting a multitude of foldable stackable chairs, each having a back with mutually oppositely disposed upper curved comers and, when folded, two, oppositely disposed, paired front and rear leg ends positioned in adjacent, offset relationship to define an outwardly opening notch, the chairs generally exhibiting constant widthwise, lengthwise, and stack height dimensions when folded. A rack apparatus including a base component is provided having a widthwise base extent of dimension corresponding substantially with the chair lengthwise dimension and extending between substantially parallel first and second longitudinal edges and having a select lengthwise base extend along a longitudinal axis. A first linear array of paired, upstanding chair leg alignment stanchions of predetermined length is provided, each having a base portion fixed to the base component at the first longitudinal edge and extending from the base portion to a top portion. Each pair of the chair leg alignment stanchions has inwardly disposed first alignment surfaces along the predetermined height thereof which slidably receive a corresponding oppositely disposed outwardly opening notch of a given chair when folded to effect one retention of that given chair in alignment for stacking. A second linear array of paired, upstanding chair back alignment stanchions of the predetermined height is provided, each of the chair back alignment stanchions having a base portion fixed to the base component at the second longitudinal edge thereof and extending from that base portion to a top portion. Each pair of the chair back alignment stanchions is located in substantial alignment with each pair of the first linear array and each pair thereof has at least one inwardly disposed second alignment surface configured, and located to slidably align for stacking the back upper curved comers of the given chair when an outwardly opening notch thereof is slidably received at one of the first alignment surfaces.

Another feature of the invention provides a system for transporting stackable chairs utilizing a tractor trailer rig having a flat bed trailer of predetermined load supporting width for supporting a load maximum height. The system comprises a plurality of foldable, stackable chairs, each having a back with mutually, oppositely disposed upper curved corners and, when folded, two, oppositely disposed, paired front and rear leg ends positioned in adjacent, offset relationship to define an outwardly opening notch, the chairs generally exhibiting to principal dimensions when folded including widthwise and lengthwise dimensions, and having a stack height dimension when folded. A rack apparatus is provided including a base frame formed as a rectangle with four comers, having a lengthwise side extent and a widthwise side extent, each of the side extents corresponding with an integer multiple of a unique one of the chair principal dimensions. Four upstanding posts of predetermined height are provided, each having a post base portion fixed to the base frame at one comer and extending upwardly to a top portion and defining with the base frame a volume providing for a predetermined number of mutually adjacent bays each retaining stacked chairs and being of bay height corresponding with the predetermined height and bay widthwise extent corresponding with the chair widthwise principal dimension. A first plurality of upstanding chair leg alignment stanchions of predetermined height is provided. These stanchions have base portions fixed to the base frame at spaced, bay defining positions and extend from the base portions to top portions. Each additionally has inwardly disposed first alignment surfaces along the predetermined height slidably receiving the outwardly opening notches of chairs when folded and stacked in two mutually adjacent bays to effect a retention of the chairs in stacked alignment within the bays. A second plurality of upstanding chair back alignment stanchions of the predetermined height is provided. These back alignment stanchions have base portions fixed to the base frame at spaced bay defining positions. The chair back alignment stanchions extend from the base positions to top portions and each is aligned with a corresponding one of the chair leg alignment stanchions to define a bay and each has inwardly disposed second alignment surfaces aligning the back upper curved comers of the chairs when folded and stacked.

As a further feature, the invention provides a method for transporting a multitude of foldable, stackable chairs to the location of a public gathering, each chair having a back with mutually oppositely disposed upper curved corners and, when folded, oppositely disposed, paired front and rear leg ends positioned in adjacent, offset relationship to define an outwardly opening notch, the chair generally exhibiting two principal dimensions when folded, including widthwise and lengthwise dimensions and having a stack height dimension when folded, comprising the steps of:

providing a rack apparatus including:

a base frame formed as a rectangle with four corners, having a lengthwise side extent and a widthwise side extent, each side extent corresponding with an integer multiple of a unique one of the chair princpal dimensions, four upstanding posts of predetermined height, each having a post base portion fixed to the base frame at one corner and extending upwardly to a top portion and defining with the base frame a volume providing for a predetermined number of mutually adjacent stacked chair retaining bays of bay height corresponding with the predetermined height and bay widthwise extent corresponding with the chair widthwise principal dimension, a first plurality of upstanding chair leg alignment stanchions of predetermined height, having base portions fixed to the base frame at spaced bay definign positions and extending from the base portions to top portions, each having inwardly disposed first alignment surfaces along the predetermined height configured to slidably receive the outward opening notches of chairs, when folded and stacked into mutually adjacent bays to effect the retention of the chairs in stacked alignment within the bays, and a second plurality of upstanding chair back alignment stanchions of the predetermined height, having base portions fixed to the base frame at spaced, bay-defining positions, the chair back alignment stanchions extending from the base portions to top portions, each being symmetrically aligned with a corresponding one of the chair leg alignment stanchions to define the bay, and each having inwardly disposed second alignment surfaces configured and located to slidably align for stacking the back upper curved corners of the chairs, when folded;

stacking a plurality of the chairs within each adjacent bay in a manner wherein the outwardly opening notch of each chair is in slidable engagement with one of the first alignment surfaces, and each chair back upper curved corner is in slidable engagement with one of the second alignment surfaces;

loading the rack apparatus upon the vehicle;

transporting the loaded rack apparatus to the vicinity of the location with the vehicle and unloading the rack apparatus thereat; and transporting the unloaded rack apparatus to the location and removing the stacked chairs therefrom.

Other objects of the invention will, in part, be obvious and will, in part, appear hereinafter.

The invention, accordingly, comprises the apparatus possessing the construction, combination of elements, and arrangement of parts and method which are exemplified in the following detailed disclosure.

For a fuller understanding of the nature and objects of the invention, reference should be had to the following detailed description taken in connection with the accompanying drawings.

DETAILED DESCRIPTION OF THE INVENTION

Figure 1:
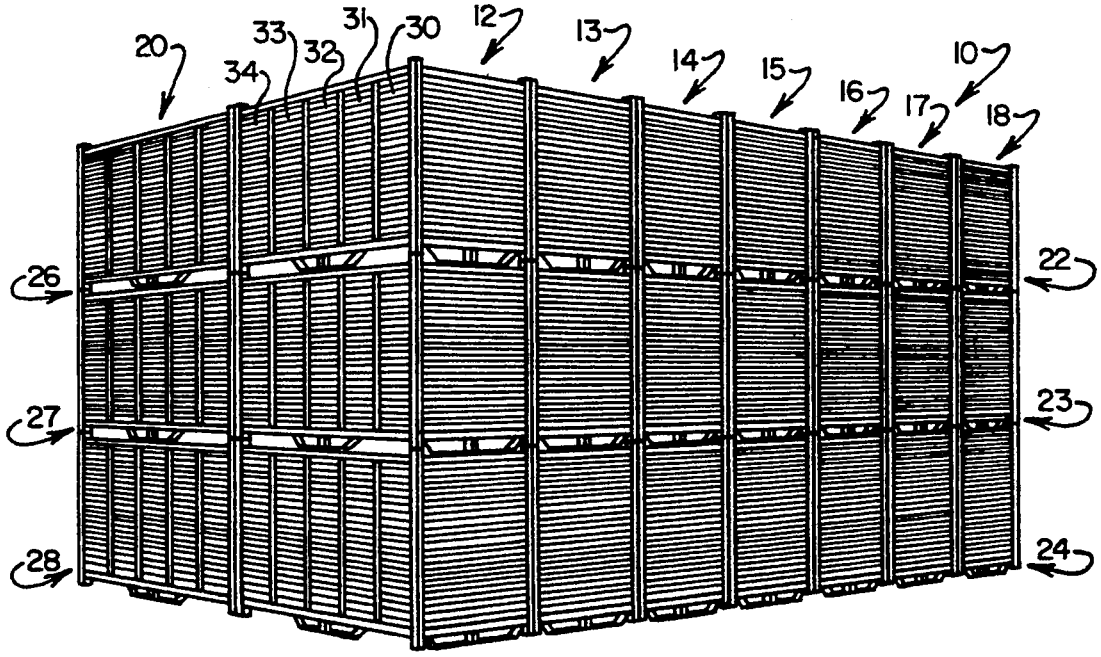
FIG. 1 is a perspective view of an assemblage of stacked rack components according to the invention.

The rack apparatus of the invention serves both to facilitate the storing of folded chairs as well as their transportation to a performance site. Referring to FIG. 1, a pictorial representation is provided showing an assemblage 10 of folding chair retaining racks. This assemblage is formed of a plurality of rack components such as represented at rows of three vertically stacked racks as at 12–18. Each of the racks within the stacks 12–18 as well as those within a second grouping 20 positioned behind racks 12 and 18 are accessed by forklift trucks. Such forklift trucks insert the fork components thereof within and through guide straps as shown at levels 22–24 for elevating the racks at their bases and moving them as desired. Similarly, access to the racks is provided from the adjacent sides thereof as represented at guide strap rows or levels 26, 27, and 28. The assemblage 10 additionally depicts the racks as being filled with folded chairs, those folded chairs being within discrete bays, for example at 30–34 in the uppermost corner rack. The stacking alignment arrangement for the racks shown is one wherein the corners are configured having male and female sliding and mating components. In a preferred rack base component arrangement, an alignment system and tube-form base frame will be seen to be employed for the purpose of maximizing the number of chairs to be contained within a limited rack height.

Figure 2:
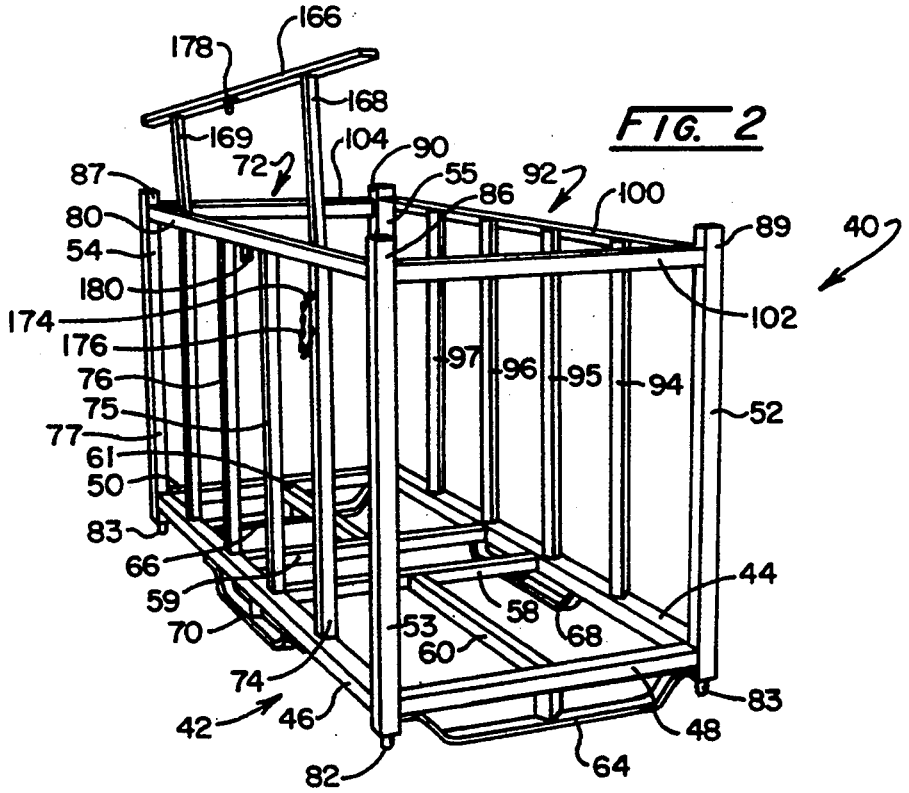
FIG. 2 is a perspective view of one embodiment of rack apparatus according to the invention.

Referring to FIG. 2, a discrete rack apparatus of the variety represented at the assemblage 10 is shown in perspective detail at 40. The apparatus 40 is seen to be formed having a base component or frame represented generally at 42. The base frame 42 is seen to be formed of longitudinal box beam members 44 and 46 and similarly dimensioned rigid widthwise end box members 48 and 50. Members 44 and 46 are united with beams 48 and 50 at four comer posts or comer stanchions 52–55. Additional bracing is provided for the base frame 42 by cross beams 58 and 59 to which are connected longitudinal bracing beams 60 and 61 extending, respectively, to end members 48 and 50. A downwardly depending forklift guide strap is connected as at 64 and 66 to the base component 42 at respective frame members 48 and 50. Similarly, forklift guide straps as at 68 and 70 are coupled to the respective box beam components 44 and 46 of base 42. It may be observed that the lower flat surfaces of these guide straps 64–70 are ground engaging and serve as the full ground support for the apparatus 40.

Figure 3:
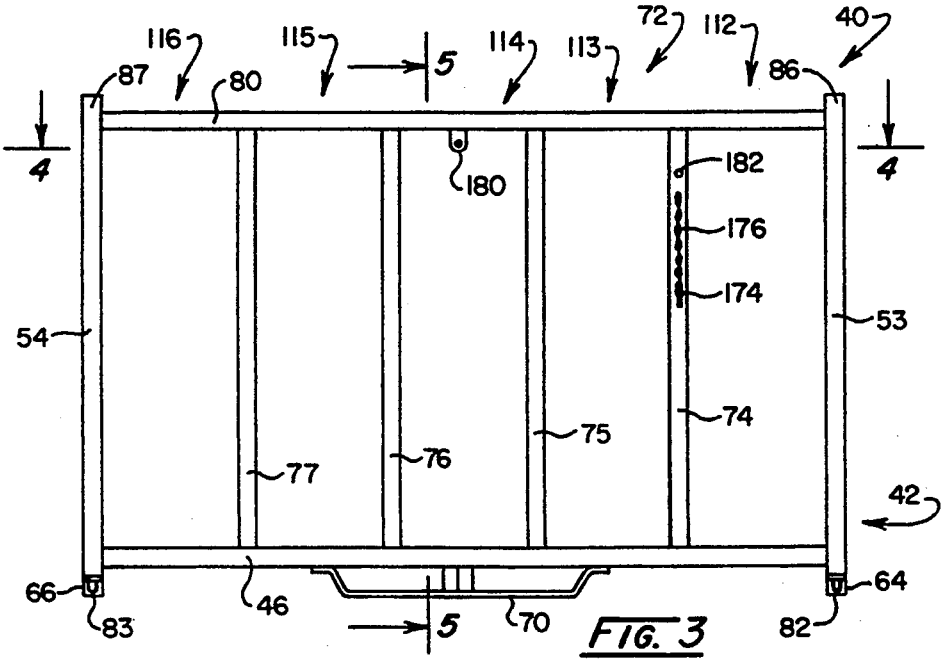
FIG. 3 is a side view of the rack apparatus of FIG. 2.
Figure 4:
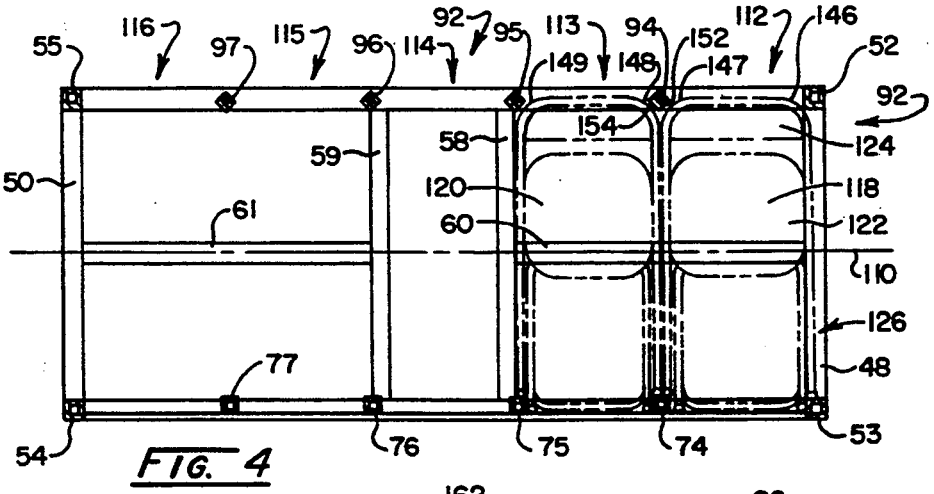
FIG. 4 is a sectional view taken through the plane 4—4 in FIG. 3.

Looking additionally to FIG. 3, positioned between the comer stanchions or posts 53 and 54 is a linear array 72 of upstanding chair leg alignment stanchions 74–77. The base portions of these stanchions 74–77 as well as the base portions of comer stanchions or posts 53 and 54 are rigidly coupled to the base frame 42 by welding or the like and extend upwardly a predetermined height to an upper bar support 80. The figures also reveal that each comer of the frame 42 as presented at the bottom portions of comer stanchions or posts 52–55 is formed having four lower stacking connectors. Two of these male connectors are seen at 82 and 83 in FIG. 3 with respect to posts 53 and 54. Identical male connectors are provided at the opposite side of frame 42, one of which is shown at 84 in FIG. 2. It may be observed in FIG. 3 that these male connectors as at 82 and 83 are retained above ground level by the guide straps 64, 66, 68, and 70. To accommodate for rack upon rack stacking, note that the top of each of the posts, for example as seen in FIG. 3 in connection with posts 53 and 54, is extended upwardly a compensating amount above the upper support bar as at 80. This compensation distance is represented in FIG. 3 at 86 and 87 for the case of respective posts 53 and 54. A similar compensating distance is provided at posts 52 and 55 as shown, respectively at 89 and 90 and illustrated in FIG. 2. Looking again to that figure, symmetrically aligned with and opposite to the array of chair leg alignment stanchions 72 is a corresponding array of chair back alignment stanchions represented generally at 92. These chair back alignment stanchions are formed having a rectangular cross section in the same manner as the stanchions of array 72, however, the stanchions, as seen at 94–97 are attached at their base portions to box beam 44 such that they are aligned at about 45° with respect to the lengthwise extent of the beam 44 or the longitudinal axis 110 of the rack apparatus 40 (FIG. 4). Stanchions 94–97 extend upwardly a predetermined height derived in conjunction with array 72 to an upper support retainer bar 100 having a flange portion 162 at the uppermost surface thereof which extends over the interior of the rack assembly 40. The structural aspects of rack apparatus 40 are completed by upper cross supports 102 and 104 to constitute an upper frame. In this regard, support 102 extends between and is fixed to and supports or laterally stiffens posts 52 and 53, while support 104 is fixed to and supports or laterally stiffens posts 54 and 55.

Figure 6:
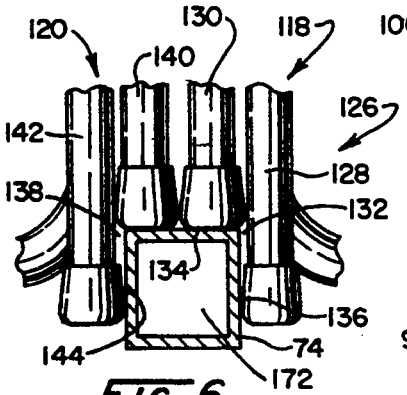
FIG. 6 is a partial sectional top view showing an alignment feature of the invention.

Referring to FIG. 4, the longitudinal axis of the rack apparatus 40 is depicted at 110. This axis 110 is seen to extend across five, chair retaining bays as are represented at 112–116. The technique of alignment of stacked, folded chairs is represented in the figure by the phantom representation of folded chain 118 and 120. Chairs 118 and 120 are identical and, when folded as illustrated in connection with chair 118 are seen to comprise a seat 122, a chair back 124, and interconnecting tubular framework represented in general at 126. Looking additionally to FIG. 6, it may be observed that the framework 126 of folded chair 18 presents, oppositely disposed paired front and rear leg ends at each chair side. As seen in FIG. 6, one such pair of leg ends is represented at 128 and 130. When the chair 118 is folded, these legs 128 and 130 are positioned in adjacent, offset relationship to define an outwardly opening notch 132. FIG. 6 shows this notch 132 being located in adjacency with alignment surfaces 134 and 136 of chair leg alignment stanchion 74 to appropriately align a comer of the chair 118 within the bay 112. A similar alignment occurs in conjunction with the oppositely disposed leg ends of chair 118 in conjunction with alignment surfaces of comer stanchion or post 53 as seen in FIG. 4. Chair leg alignment stanchion 74 also performs an aligning function in conjunction with a corresponding outwardly opening notch 138 defined by paired front and rear leg ends 140 and 142 of adjacent chair 120. In this regard, note that alignment surfaces 134 and 144 of chair leg alignment stanchion 74 serve this alignment function.

Now looking to the upper side of folded chair 118, it may be seen in FIG. 4 that it is formed having upwardly disposed curved comers 146 and 147. Similarly, chair 120 is seen to have upwardly disposed curved comers 148 and 149. The chair curved end 147 of chair 118 is positioned in slidable tangential adjacency with one alignment surface 152 of chair back alignment stanchion 94. Similarly, the curved component 148 of chair 120 is in sliding tangential adjacency with the alignment surface 154 of stanchion 94. A comer of post 52 serves the same function with respect to comer 146 of chair 118.

With the arrangement shown, for each of the bays 112–116, an alignment is provided with respect to the four comers of the chairs as at 118 and 120. These chairs all have substantially constant principal widthwise and lengthwise dimensions which, in turn, dictate the dimension of chair retaining bays 112–116. Accordingly, a widthwise extent of a given bay for the rack apparatus 40 will correspond with the widthwise dimension of the chairs. As is illustrated later herein, that widthwise extent also determines the length along axis 110 of apparatus 40 along with a consideration of the corresponding width of a conventional flat bed trailer of a tractor trailer rig.

Figure 5:
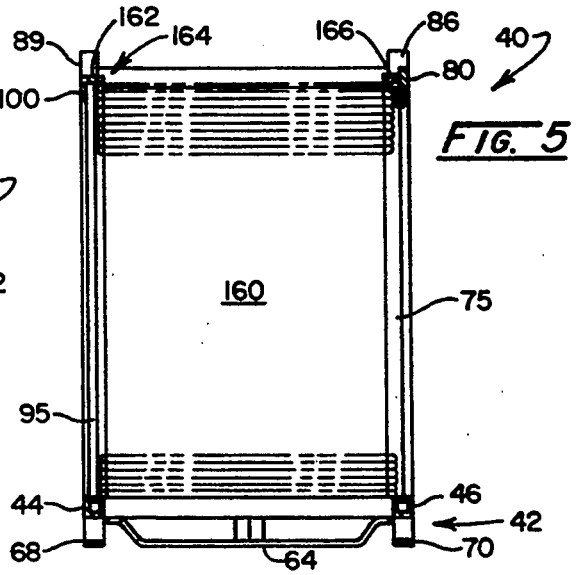
FIG. 5 is a sectional view taken through the plane 5—5 shown in FIG. 3.

Chairs as at 118 and 120 additionally have a constant stacking height, for example of about 1 inch. Thus, the predetermined effective heights of the stanchions as at 74–77, 94–97, aid the comer stanchions or posts 52–55 is selected with respect to the number of chairs desired to be stacked within a given bay. Looking to FIG. 5, an array of stacked chairs is represented in general at 160 extending from the base frame or component 42 upwardly a predetermined height which is determined, as noted above by the stack height of the chairs and the restrictions on total transportation load weight and height as regulated by governmental entities. A maximum loaded weight may be, for example, 80,000 pounds. Rack apparatus 40, fabricated of 10 gauge steel will weigh, empty, about 300 pounds. The chairs, typically having folded dimension of $17\frac{1}{2}'' \times 39\frac{1}{4}''$ weigh about 6.5 pounds a piece. The predetermined effective height of the apparatus 40 will vary with trailer heights. Interstate highway regulations currently limit load or wailer top height to 13.5 feet. Considering this restriction and the variations in wailer heights, effective rack apparatus heights of 51 inches to 61 inches have been selected. Generally, one rack apparatus 40 will carry a total of 190 chairs, stacking 36 chairs within each of the five bays. This height also is selected so that the array of stacked folded chairs 160 may be secured in place such that the rack 40 may be left at a performance site overnight pending retrieval by a crew following a performance on a following day. Note in this regard that the upper support retainer bar 100 is configured having an inwardly extending flange portion 162 which extends over the upper or chair back frame or framework region of the chairs as represented in the figure at 164. Thus, the loading crew fills a given bay by stacking the chairs therein in slidable alignment provided by the alignment surfaces of the chair leg alignment stanchions and the chair back alignment stanchions. After a predetermined number of chairs as established by the constant chair stacking height has been stacked, the last chair to be positioned will abut against the inner surface of inwardly extending flange portion 162 of upper support retainer bar 100. Correspondingly, the oppositely disposed chair leg end components as described in connection with FIG. 6 will be positioned adjacent the vertically oriented upper support and retainer bar 80. To lock the assemblage into place, an elongate retainer bar 166 is locked down over the chair end components at the top of the stacked array within all bays. When properly, uniformly stacked, only a constant, fixed number of chairs will fit within a bay. Thus, the chair counting procedure heretofore required during track loading can be eliminated or substantially minimized.

Returning to FIG. 2, this retainer bar 166 is revealed in conjunction with a rack apparatus orientation representing a chair unloading mode. In this regard, the retainer bar 166 is seen to have two downwardly depending and vertical support and alignment bars 168 and 169 which slide within the interior cavities of respective stanchions 74 and 77. One such inner cavity, for example, with respect to stanchion 74, is revealed at 172 in FIG. 6. The retainer bar 166 is retained in the orientation shown at FIG. 2 for unloading by a pin 174 carried on the apparatus 40 with a small chain 176, and inserted through mating holes or bores within stanchion 74 and sliding bar 168. The bar 166 is moved downwardly to the orientation shown in FIG. 5 by removing the pin 174. As the bar 166 descends, an annular opening within a downwardly depending locking tab 178 descends into alignment with an opening within a corresponding locking tab 180 depending downwardly from retainer bar 80. A simple padlock then may be employed to lock the assemblage into place. Pin 174 and chain 176 are revealed at a heightened degree of clarity in FIG. 3 in conjunction with the pin opening formed within stanchion 74 for the purpose of receiving pin 174.

Design criteria for the rack assemblies of the invention are concerned with portability such that they may be moved by a forklift truck with safety and ease; maximized chair retention to take full advantage of moving as many chairs as possible with a given rack; security for overnight storage at a performance site; and assurance for many applications that no damage will be done to the grass or turf at the performance sites by the racks themselves as they are moved into positions adjacent the location of performance. In this regard, it is desirable that the racks not be positioned, for example, on the turf of a football field. However, occasions may arise where that situation will occur inadvertently.

Figure 7:
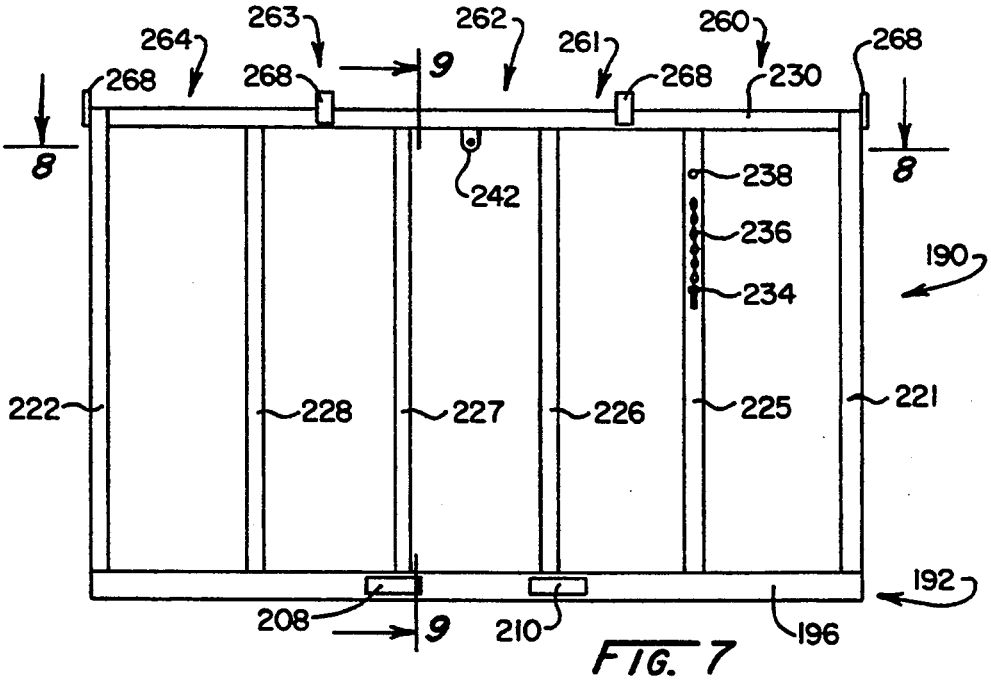
FIG. 7 is a side view of another embodiment of a rack apparatus according to the invention.
Figure 8:
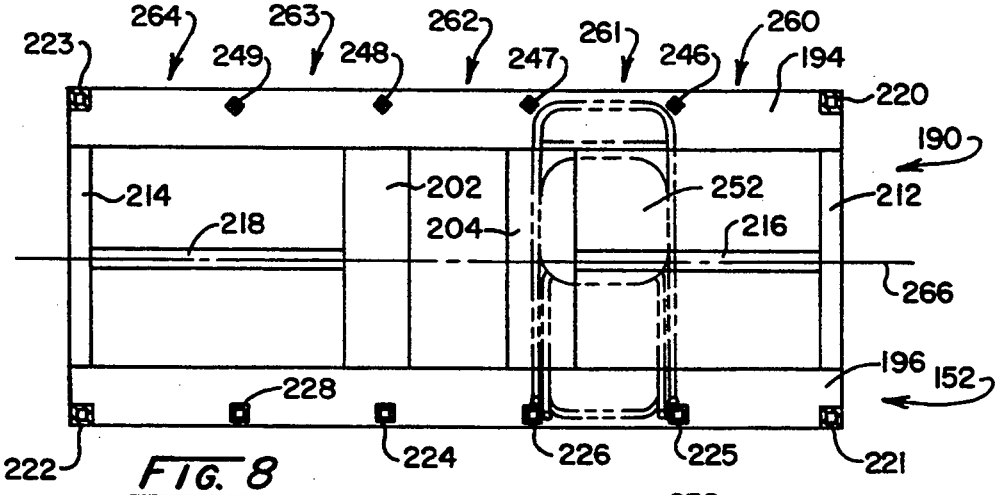
FIG. 8 is a sectional view taken through the plane 8—8 shown in FIG. 7.
Figure 9:
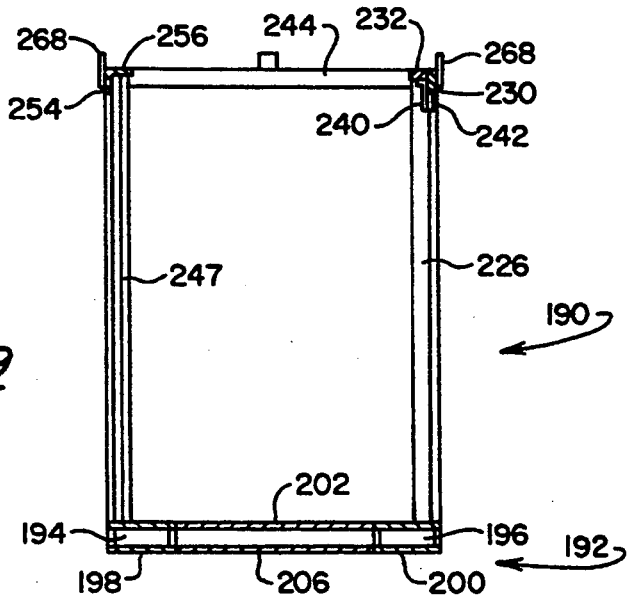
FIG. 9 is a sectional view taken through the plane 9—9 shown in FIG. 7.

FIGS. 7, 8, and 9 reveal another embodiment of the invention further improving the criteria of maximized chair retention for a given rack apparatus height and preservation of performance locale turf. In the figures, a rack apparatus is represented generally at 190 having a base frame or component 192. The figures reveal that the base frame 192 is formed of two elongate rectangular rigid tubes 194 and 196 which have flat ground engaging surfaces as are seen, respectively, in FIG. 9 at 198 and 200. That figure additionally reveals that the tubes 194 and 196 are open at their ends such that they may receive the fork tines of a forklift truck. The rectangular shape of the base frame 192 is developed through the utilization of two additional and similarly dimensioned rectangular rigid tubes seen in FIG. 8 at 202 and 204. FIG. 9 reveals that the lower surface of tube 202 at 206 is coextensive or coplanar with the lower surfaces 198 and 200 of respective longitudinal tubes 194 and 196. Tube 204 is similarly symmetrically positioned within the base frame 192. Accordingly, the weight of rack apparatus 190 is distributed over a substantially greater ground engaging surface, such that turf damage is substantially avoided when the devices are improperly positioned on such turf.

Tubes 202 and 204 are hollow and rigidly attached to the longitudinal tubes 194 and 196. Their effective length is coextensive with the widthwise dimension of the base frame 192 by virtue of openings cut in the inwardly and outwardly disposed side surfaces of the latter tubes 194 and 196. These openings are in alignment with the interiors of tubes 202 and 204 such that interior channels are developed which are positioned and dimensioned to receive the tines of a forklift truck. Such openings provide access to the tubes and for insertion of the fork component with respect to one side are shown in FIG. 7 at 208 and 210 providing channel definition as communication with respective tubes 202 and 204. Base frame 192 is completed with additional structural members including cross members 212 and 214 which correspond, respectively, with cross beams 48 and 50 as seen in FIG. 4. Additionally, the frame includes longitudinal bracing beams 216 and 218 corresponding, respectively, with beams 60 and 61 as seen in FIG. 4.

The bay defining structure or geometry of the rack apparatus 190 is the same as that for the rack assembly 40. In this regard, FIG. 8 reveals the provision of four upstanding corner posts or alignment stanchions 220–223 corresponding with respective corner posts 52–55 of apparatus 40. Positioned between posts or stanchions 221 and 222 are upstanding chair leg alignment stanchions 225–228 which extend to an upper support retainer bar 230 as seen in FIGS. 7 and 9 and which corresponds to the support bar 80 shown in FIG. 5. As before, the support bar 230 as well as stanchions 225 and 228 are configured for association with a securing retainer component as described in FIG. 2 at 166 and shown at 232 in FIG. 9. The same form of chair securement is provided including a loading mode orientation for the component 232 involving, for example, a pin 234, retaining chain 236, and pin opening 238 as seen in FIG. 7 which are identical to the corresponding components 174, 176, and 182 seen in FIG. 3. In similar fashion, a downwardly depending locking tab is seen at FIG. 9 at 240 as extending from component 232. This locking tab moves into mating relationship with downwardly extending tab 242 as seen in FIG. 7. Tab 242 corresponds with tab 180 as described in connection with FIG. 3, while tab 240 corresponds with tab 178 as described in FIG. 2. Cross bars extend across the upper portions of the posts 220 and 221 and posts 222 and 223. One such cross bar is shown at 244 in FIG. 9.

Returning to FIG. 8, rack apparatus 190 also includes an array of four upstanding chair back alignment stanchions 246–249 which are regularly spaced between posts 220 and 223. Stanchions 246–249 are configured identically with those described in connection with FIG. 3 at 94–97 and carry out the same chair back alignment feature as represented in phantom by the association thereof with a chair 252. FIG. 9 shows that the expanding chair back aligning stanchions 246–249, as well as the corresponding comer posts 220 and 223 extend to an upper support retainer bar 254 having an inwardly extending flange 256. Flange 256 as well as the bar 254 correspond, respectively, with the components 100 and 162 described in connection with FIG. 5.

Thus configured, the rack apparatus 190 provides for five adjacent chair stacking and aligning bays 260–264 which are positioned in mutual adjacency and oriented perpendicularly to a longitudinal axis 266 corresponding with the lengthwise extent of apparatus 190.

To provide for rack upon rack stacking of the rack apparatus 190, the bottom fiat rectangular surface serves as one component for connection. This flat rectangular lower portion of the base frame 192 is retained in alignment upon the top frame components of a lower disposed rack by upstanding tags seen at 268 in FIGS. 7 and 9 which are disposed about the upper support components of the apparatus 190. Thus, a forklift apparatus is employed to lift one rack using the rigid tube base structure and position it upon the next adjacent rack with the tabs 268 providing for final alignment such that load transfer is symmetrically downwardly directed from one rack to the next.

In addition to providing for improved turf protection at a performance site, the rack apparatus embodiment 190 also permits the loading of a greater number of chairs, for example two additional chairs per bay, while maintaining the same height as the embodiment at 40. This represents a significant enhancement when considering the number of chairs carried by a single trailer.

Figure 10:
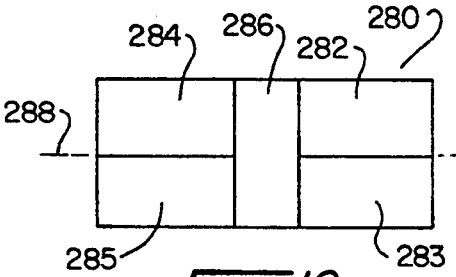
FIG. 10 is an alternate arrangement showing bay geometry for a rack apparatus according to the invention.

The base structuring shown in the embodiments of FIGS. 1–9 is one wherein the bays are aligned in parallel and transversely to the longitudinal axis of the rack apparatus. Other bay geometries will occur to the designer. Looking to FIG. 10, another bay geometry is represented in general at 280 as including four bays 282–285 which are arranged such that the principal longitudinal dimension of the folded chairs will be parallel with the longitudinal axis 288 of the assembly and one bay 286 is arranged transversely thereto.

Figure 11:
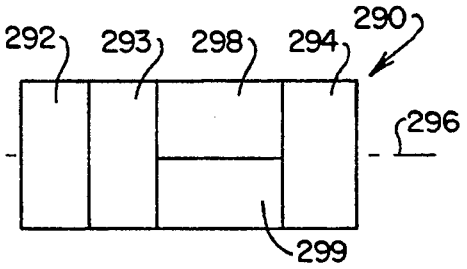
FIG. 11 is another alternate geometry showing bay arrangement for a rack apparatus according to the invention.

Looking to FIG. 11, still another arrangement of bays is represented at 290. In arrangement 290, three bays 292–294 are arranged transversely to the longitudinal axis 296 of the apparatus. To complete the assembly, two bays as 298 and 299 are located intermediate bays 293 and 294 and are arranged such that the principal longitudinal dimension or height of the chairs are parallel with the central longitudinal axis 296.

Figure 12:
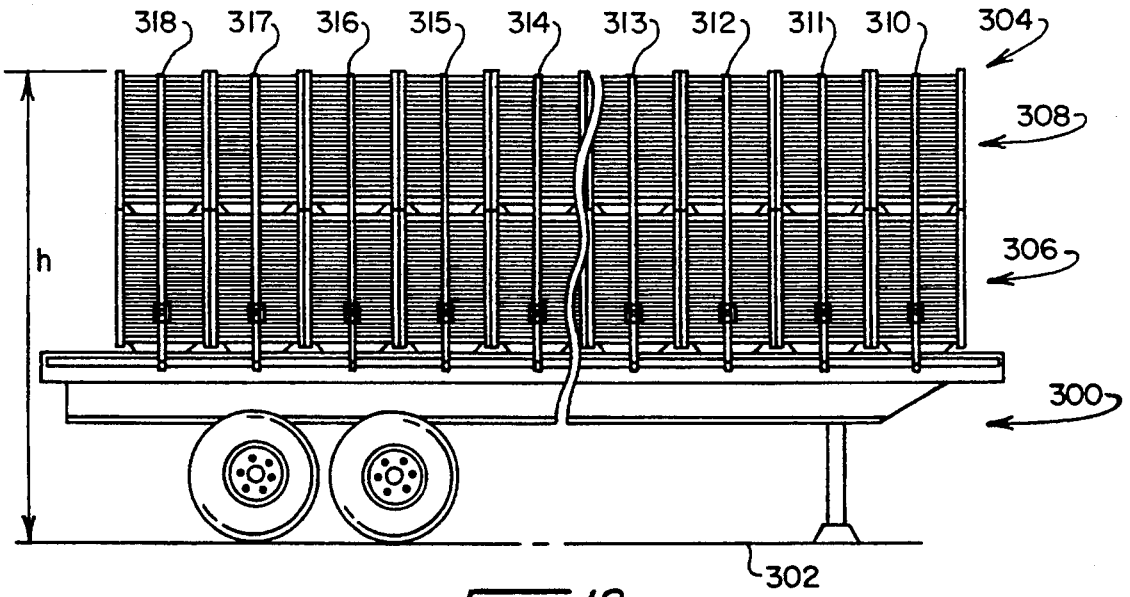
FIG. 12 is a side view of a flat bed trailer upon which rack assemblages according to the invention are loaded.

Referring to FIG. 12, a representation of the flat bed trailer 300 of a tractor trailer rig is illustrated as being positioned upon a surface 302. Upon the trailer 300 there are stacked rack apparatus according to the invention and represented at 304. It may be observed that two rack levels as at 306 are provided, the thus stacked rack pairs being retained upon the bed of the trailer 300 by straps as at 310–318. As is apparent, these individual rack components of the assemblage 304 are readily loaded and removed by a forklift truck. The carrying of assemblage 304 upon the trailer 300 is subject to the limitations of height, h, as represented in the drawings and by the overall weight of the assemblage. Thus, the selection of the predetermined height of the rack is predicated, in pan, upon the available height, h, for transportation. It is desirable to maximize the number of chairs carried on the trailer 300, thus the value of the rack apparatus 190 embodiment, providing for the stacking of a greater number of chairs per bay becomes evident.

Figure 13:
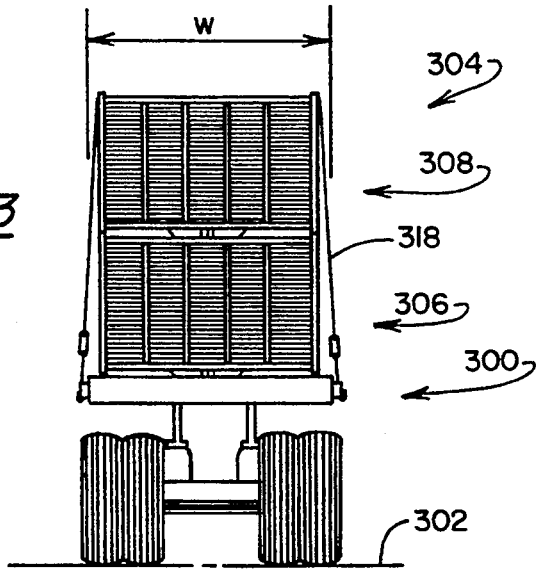
FIG. 13 is a back view of the trailer of FIG. 12.

Looking additionally to FIG. 13, the trailer 300 and rack assemblage 304 again is illustrated as a rear view. Here, the available loading width, w, of the trailer 300 is considered additionally in determining the lengthwise extent of the chair racking devices. Generally, the number of bays will be 5 for conventional flat bed trailers.

Since certain changes may be made in the above described system and apparatus without departing from the scope of the invention herein involved, it is intended that all matter contained in the description thereof or shown in the accompanying drawings shall be interpreted as illustrative and not in a limiting sense.

I claim:

1. A system for retaining and transporting chairs, comprising:

a plurality of foldable, stackable chairs, each having a back with mutually oppositely disposed upper curved corners and, when folded, two, oppositely disposed, paired front and rear leg ends positioned in adjacent, offset relationship to define an outwardly opening notch, said chairs generally exhibiting constant widthwise, lengthwise and stack height dimension when folded; and a rack apparatus including:

a base component having a widthwise base extent of dimension corresponding substantially with said the chair lengthwise dimension and extending between substantially parallel first and second longitudinal edges and having a select lengthwise base extent along a longitudinal axis;

a first linear array of paired, upstanding chair leg alignment stanchions of predetermined height, each having a base portion fixed to said base component at said first longitudinal edge and extending from said base portion to a top portion, each pair thereof having inwardly disposed first alignment surfaces along said predetermined height slidably receiving a corresponding oppositely disposed said outwardly opening notch of a given said chair when folded to effect one retention of said given chair in alignment for stacking; and a second linear array of paired, upstanding chair back alignment stanchions of said predetermined height, each having a base portion fixed to said base component at said second longitudinal edge and extending from said base portion to a top portion, each said pair thereof being located in symmetrical alignment with each said pair of said first linear array and each said pair thereof having at least one inwardly disposed second alignment surface configured and located to slidably align for stacking said back upper curved corners of said given chair when a said outwardly opening notch thereof is slidably received at one of said first alignment surfaces.

2. The system of claim 1 in which:

said base component is generally rectangular having four corners;

two said chair leg alignment stanchions are corner leg stanchions each located at a said corner at said first longitudinal edge;

two said chair back alignment stanchions are corner chair back alignment stanchions located at two said corners at said second longitudinal edge;

each said corner chair leg alignment stanchion and each said corner chair back alignment stanchion upwardly terminates in a rack stacking upper connector;

said base is configured having four lower connectors fixed thereto and extending downwardly and each in slidable mating alignment with one said upper connector of another said rack apparatus, so as to provide for the overhead stacking of one said rack apparatus upon another.

3. The system of claim 1 in which each said chair leg alignment stanchion is configured having a rectangular cross section defining four outwardly disposed surfaces, one said surface being inwardly disposed and parallel to said longitudinal axis to provide one of said first alignment surfaces, an adjacent said surface being perpendicular to said longitudinal axis to provide another of said first alignment surfaces.

4. The system of claim 1 in which at least one said chair back stanchion of each said pair thereof is configured having a said inwardly disposed second alignment surface oriented at an acute angle with respect to said longitudinal axis, said acute angle being selected for tangential slidable contact with an adjacent said back upper curved corner.

5. The system of claim 1 in which:

said predetermined height is an integer multiple of said chair stack height positioning the top of the uppermost chair of a full stack retained within said rack apparatus substantially at said predetermined height;

including a first elongate retainer component mounted upon said first linear array of chair leg alignment stanchions at said top portion of each thereof and extending in abutting and securing relationship over said chair leg ends of said uppermost chair; and a second elongate retainer component mounted upon said second linear array of chair back alignment stanchions at said top portion of each thereof and extending in abutting and securing relationship over the upper portion of said back of said uppermost chair.

6. The system of claim 5 including locking means for locking one of said first and second elongate retainer components upon said rack apparatus.

7. The system of claim 1 in which said base component lengthwise base extent is selected in correspondence with an integer multiple of said chair widthwise dimension.

8. The system of claim 1 in which at least one said chair back stanchion of each said pair thereof is configured having a rectangular cross section with two, inwardly disposed, mutually perpendicular surfaces, each defining a said second alignment surface and oriented substantially at a 45° angle with respect to said longitudinal axis.

9. The system of claim 1 including:

first ground engaging guide straps mounted upon said base component perpendicularly to said longitudinal axis and extending therebelow a distance defining an opening for receiving a lifting fork; and second ground engaging guide straps mounted upon said base component in parallel relationship with said longitudinal axis and extending therebelow said distance defining an opening for receiving a lifting fork.

10. The system of claim 1 in which said base component comprises:

first and second spaced elongate rectangular rigid tubes having lengthwise extents parallel with said longitudinal axis, each having an effective length corresponding with said lengthwise extent, said first and second tubes being open at the ends thereof, extending from a top surface to a flat ground engaging surface a dimension effective for receiving a lifting fork, said first and second tubes having laterally outwardly disposed side surfaces defining said base widthwise extent; and said first linear array of paired, upstanding chair leg stanchions and said second array of paired, upstanding chair back alignment stanchions are mounted upon said first and second rigid tubes.

11. The system of claim 10 in which said base component further comprises:

third and fourth spaced rectangular rigid tubes, each having an effective length corresponding with said widthwise extent and having openings at the ends thereof for receiving a lifting fork, each said third and fourth tubes extending from a top surface disposed substantially coplanarly with said each top surface of said first and second tubes to a flat ground engaging surface arranged to be substantially coplanar with said flat, ground engaging surface of each said first and second tubes.

12. A system for transporting chairs utilizing a tractor-trailer rig having a flat bed trailer of predetermined load supporting width for supporting a load of maximum height, comprising:

a plurality of foldable, stackable chairs, each having a back with mutually oppositely disposed upper curved corners and, when folded, two oppositely disposed, paired front and rear leg ends positioned in adjacent, offset relationship to define an outwardly opening notch, said chairs generally exhibiting two principal dimensions when folded;

a rack apparatus including:

a base frame formed as a rectangle with four corner, having a lengthwise side extent and a widthwise side extend, each said side extent corresponding with an integer multiple of a unique one of said chair principal dimensions;

four upstanding posts of predetermined height, each having a post base portion fixed to said base frame at one said corner and extending upwardly to a top portion and defining with said base frame a volume providing for a predetermined number of mutually adjacent bays each retaining stacked said chairs and being of bay height corresponding with said predetermined height and bay widthwise extent corresponding with said chair widthwise principal dimension;

a first plurality of upstanding chair leg alignment stanchions of predetermined height, having a base portions fixed to said base frame at spaced bay defining positions and extending from said base portions to top portions, each having inwardly disposed first alignment surfaces along said predetermined height slidably receiving said outwardly opening notches of chairs, when folded and stacked in two, mutually adjacent said bays to effect a retention of said chairs in stacked alignment within said bays; and a second plurality of upstanding chair back alignment stanchions of said predetermined height, having base portions fixed to said base frame at spaced, bay defining positions, said chair back alignment stanchions extending from said base portions to top portions, each being symmetrically aligned with a corresponding one of said chair leg alignment stanchions to define said bay, and each having inwardly disposed second alignment surfaces aligning said back upper curved corners of said chairs, when folded and stacked.

13. The system of claim 12 in which said lengthwise side extent of said base frame corresponds with said load supporting width of said flat bed trailer.

14. The system of claim 12 in which:

each said post top portion is configured having a rack stacking upper connector;

said base frame is configured having four lower connectors fixed thereto in slidable, mating alignment with said upper connectors of another rack apparatus, so as to provide for stacking of one said rack apparatus upon another;

said predetermined height of said chair leg alignment stanchions and said chair back alignment stanchions corresponds with an integer multiple of said chair stack height, and further being selected such that the combined height of two said rack apparatus, when one is stacked upon the other and the stacked combination is positioned upon said trailer, is less than said load maximum height.

15. The system of claim 12 in which:

said predetermined height is an integer multiple of said chair stack height, positioning the top of the uppermost chair of a full stack filling a said bay substantially at said predetermined height;

said first plurality of upstanding chair leg alignment stanchions is provided as a first linear array thereof extending between first and second oppositely disposed said posts;

said second plurality of upstanding chair back alignment stanchions is provided as a second linear array thereof extending between third and fourth oppositely disposed said posts;

including a first elongate retainer component mounted upon said first linear array of chair leg alignment stanchions at said top portions thereof and extending in abutting and securing relationship over said chair leg ends of said uppermost chair;

a second elongate retainer component mounted upon said second linear array of chair back alignment stanchions at said top portion thereof and extending in abutting and securing relationship over the upper portion of said back of said uppermost chair.

16. The system of claim 12 including:

first ground engaging guide straps mounted upon said base frame along said widthwise side extent and extending below said base frame a distance defining an opening for receiving a lifting fork; and second ground engaging guide straps mounted upon said base frame along said lengthwise extent and extending below said base frame said distance defining an opening for receiving a lifting fork.

17. The system of claim 12 in which said base frame comprises:

first and second spaced elongate rectangular rigid tubes having lengthwise extents parallel with said lengthwise side extent, each having an effective length corresponding with a said base frame side extent and being open at the ends thereof and extending from a top surface to a flat, ground engaging surface a dimension effective for receiving a lifting fork.

18. The system of claim 17 in which:

said four upstanding posts, said first plurality of upstanding chair leg alignment stanchions and said second plurality of upstanding chair back alignment stanchions extend upwardly for connection with top frame members having horizontal coplanar top surfaces of extent effective to support said base frame of another said rack apparatus in rack stacking relationship; and including upstanding base frame alignment means fixed to said top frame members for horizontally aligning said base frame of one upper said rack apparatus upon said top frame members of a lower disposed said rack apparatus.

19. The rack apparatus of claim 17 in which said alignment means comprises upwardly extending tab members.

20. System for storing and transporting a multitude of foldable, stackable chairs, each having a back with mutually oppositely disposed upper curved corners and, when folded, two oppositely disposed, paired front and rear leg ends positioned in adjacent, offset relationship to define an outwardly opening notch, said chairs generally exhibiting two principal dimensions when folded including widthwise and lengthwise dimensions and having a stack height dimension when folded, and being transportable by a tractor-trailer rig having a flat bed trailer of predetermined load supporting width for supporting a load of maximum height, comprising:

a base frame formed as a rectangle with four corners, having a lengthwise side extent and a widthwise side extent, each said side extent corresponding with an integer multiple of a unique one of said chair principal dimensions;

four upstanding posts of predetermined height, each having a post base portion fixed to said base frame at one said corner and extending upwardly to a top portion and defining with said base frame a volume providing for a predetermined number of mutually adjacent stacked chair retaining bays of bay height corresponding with said predetermined height and bay widthwise extent corresponding with said chair widthwise principal dimension;

a first plurality of upstanding chair leg alignment stanchions of predetermined height, having base portions fixed to said base frame at spaced bay defining positions and extending from said base portions to top portions, each having inwardly disposed first alignment surfaces along said predetermined height configured to slidably receive said outwardly opening notches of chairs, when folded and stacked in two, mutually adjacent said bays to effect a retention of said chairs in stacked alignment within said bays, and said stanchions configured having a rectangular cross section defining four outwardly disposed surfaces, three of said surfaces providing two of said first alignment surfaces; and a second plurality of upstanding chair back alignment stanchions of said predetermined height, having base portions fixed to said base frame at spaced, bay defining positions, said chair back alignment stanchions extending from said base portions to top portions, each being symmetrically aligned with a corresponding one of said chair leg alignment stanchions to define said bay, and each having inwardly disposed second alignment surfaces configured and located to slidably align for stacking said back upper curved corners of said chairs, when folded, and said stanchions configured having two adjacently disposed second alignment surfaces oriented at a predetermined angle with respect to a said first alignment surface, said angle being selected for tangential slidable contact with a said chair back upper curved surface.

21. The method for transporting a multitude of foldable, stackable chairs to the location of a public gathering, each said chair having a back with mutually oppositely disposed upper curved corners and, when folded, oppositely disposed, paired front and rear leg ends positioned in adjacent, offset relationship to define an outwardly opening notch, said chairs generally exhibiting two principal dimensions when folded including widthwise and lengthwise dimensions and having a stack height dimension when folded, comprising the steps of:

providing a rack apparatus including:

a base frame formed as a rectangle with four corners, having a lengthwise side extent and a widthwise side extent, each said side extent corresponding with an integer multiple of a unique one of said chair principal dimensions;

four upstanding posts of predetermined height, each having a post base portion fixed to said base frame at one said corner and extending upwardly to a top portion and defining with said base frame a volume providing for a predetermined number of mutually adjacent stacked chair retaining bays of bay height corresponding with said predetermined height and bay widthwise extent corresponding with said chair widthwise principal dimension;

a first plurality of upstanding chair leg alignment stanchions of predetermined height, having base portions fixed to said base frame at spaced bay defining positions and extending from said base portions to top portions, each having inwardly disposed first alignment surfaces along said predetermined height configured to slidably receive said outwardly opening notches of chairs, when folded and stacked in two, mutually adjacent said bays to effect a retention of said chairs in stacked alignment within said bays, and a second plurality of upstanding chair back alignment stanchions of said predetermined height, having base portions fixed to said base frame at spaced, bay defining positions, said chair back alignment stanchions extending from said base portions to top portions, each being symmetrically aligned with a corresponding one of said chair leg alignment stanchions to define said bay, and each having inwardly disposed second alignment surfaces configured and located to slidably align for stacking said back upper curved corners of said chairs, when folded;

stacking a plurality of said chairs within each said adjacent bay in a manner wherein said outwardly opening notch of each said chair is in slidable engagement with one of said first alignment surfaces, and each said chair back upper curved corner is in slidable engagement with one of said second alignment surfaces;

loading said rack apparatus upon a vehicle;

transporting said loaded rack apparatus to the vicinity of said location with said vehicle and unloading said rack apparatus thereat; and transporting said unloaded rack apparatus to said location and removing said stacked chairs therefrom.

22. The method of claim 21 in which said stacking of said chairs is carried out to provide a chair stack height substantially coextensive with said predetermined height to provide a consistent, predetermined number of said chairs stacked within each said bay.

* * * * *